United States Patent [19]

George

[11] Patent Number: 4,576,233

[45] Date of Patent: Mar. 18, 1986

[54] DIFFERENTIAL PRESSURE ACTUATED VENT ASSEMBLY

[75] Inventor: Flint R. George, Katy, Tex.

[73] Assignee: Geo Vann, Inc., Houston, Tex.

[21] Appl. No.: 425,626

[22] Filed: Sep. 28, 1982

[51] Int. Cl.[4] ..... E21B 43/112

[52] U.S. Cl. ..... 166/297; 166/299; 166/373

[58] Field of Search ..... 166/299, 297, 373, 317, 166/318, 319, 321, 323; 137/68 R, 494; 251/62, 63.5; 175/4.56

[56] References Cited

U.S. PATENT DOCUMENTS

| | | | |
|---|---|---|---|
| 2,169,559 | 8/1939 | Halliburton | 166/1 |
| 2,330,509 | 9/1943 | McCullough | 166/1 |
| 2,456,977 | 12/1948 | McCullough | 89/1 |
| 2,530,966 | 11/1950 | Huber | 166/5 |
| 2,601,122 | 6/1952 | McKinley | 166/1 |
| 2,681,110 | 6/1954 | Harrison | 166/55 |
| 2,745,495 | 5/1956 | Taylor | 166/35 |
| 2,760,408 | 8/1956 | Taylor | 89/1 |
| 2,847,072 | 8/1958 | Le Bourg | 166/46 |
| 2,906,339 | 9/1959 | Griffin | 166/35 |
| 2,935,131 | 5/1960 | McCune | 166/45 |
| 3,011,551 | 12/1961 | Young et al. | 166/55.1 |
| 3,071,193 | 1/1963 | Raulins | 166/226 |
| 3,118,501 | 1/1964 | Kenley | 166/55.4 |
| 3,151,681 | 10/1964 | Cochran | 166/224 |
| 3,165,153 | 1/1965 | Lanmon | 166/4 |
| 3,189,094 | 6/1965 | Hyde | 166/55.1 |
| 3,239,008 | 3/1966 | Leutwyler | 166/319 |
| 3,273,650 | 9/1966 | Alexander et al. | 166/317 |
| 3,291,207 | 12/1966 | Rike | 166/4 |
| 3,482,628 | 12/1969 | Griffin | 166/152 |
| 3,662,834 | 5/1972 | Young | 166/319 |
| 3,706,344 | 12/1972 | Vann | 166/297 |
| 3,931,855 | 1/1976 | Vann et al. | 166/128 |
| 4,257,484 | 3/1981 | Whitley et al. | 166/321 X |
| 4,299,287 | 11/1981 | Vann et al. | 166/318 |
| 4,330,039 | 5/1982 | Vann | 166/317 |

FOREIGN PATENT DOCUMENTS

| | | | |
|---|---|---|---|
| 2040342 | 8/1980 | United Kingdom | 166/317 |

OTHER PUBLICATIONS

McCullough Tool Company 1941, 1953, 1955, 1957, and 1960–1961 Catalogues.

*Primary Examiner*—Stephen J. Novosad
*Assistant Examiner*—William P. Neuder
*Attorney, Agent, or Firm*—James R. Duzan; Eugene L. Flanagan, III; David Alan Rose

[57] ABSTRACT

A differential pressure actuated vent assembly is connected into an oil well tool string. In one form of the invention, the tool string includes a packer device, a perforating gun attached to the lower end of the tubing string, with the vent assembly being interposed between the gun and the packer device. Fluid pressure within the tubing string is effected on one face of a piston associated with the vent assembly, which reciprocates the piston and communicates the interior of the tubing string with the annulus around the tubing string while carrying out the step of perforating the formation. Movement of the piston and the subsequent detonation of the gun preferably are both accomplished sequentially in response to the dropping of a bar down through the tool string. The bar opens a passageway leading to the piston, and immediately thereafter, before the pressure differential between the interior of the tubing string and the annulus is equalized, the gun is detonated, thereby obviating damage to the formation.

5 Claims, 6 Drawing Figures

DIFFERENTIAL PRESSURE ACTUATED VENT ASSEMBLY

BACKGROUND OF THE INVENTION

In completing an oil and/or gas well, the cased borehole is perforated at the payzone by shooting holes or perforations through the casing, the surrounding cement, and into the hydrocarbon formation to permit the hydrocarbons to flow into the cased borehole and up to the surface. It is often desirable to place a predetermined underbalance or a predetermined overbalance on the formation. In doing so, a tubing string with a vent assembly, and generally a perforating gun if the well is to be perforated, is lowered into the cased borehole. A hydrostatic head is placed inside the tubing string to establish the predetermined underbalance or overbalance on the formation. Such a method and apparatus have several applications depending upon the particular environment.

After a well has been produced for many years, geologists skilled in the art of interpreting downhole logs sometime discover that the producing formation should be reperforated to create additional perforations to increase production. Often in the prior art, a through-tubing perforating gun had originally been used instead of a casing gun such that the original perforations were not deep enough to adequately produce the formation. Also, sometimes metal shots such as bullets were used for perforating rather than shaped charges such that good perforations were not achieved. In such cases, the perforations may not have reached the sterile formation and it becomes desirable to reperforate the formation to increase production.

It may also be discovered that additional perforations should advantageously be formed in the casing at a location spaced above or below the old perforations. This can often significantly increase the production from the old formation. Sometimes, the formation was missed completely at the time of the first perforation where the perforations were too high or too low with respect to the payzone.

Moreover, it sometimes happens that other payzones closely adjacent to the older perforated zones have been overlooked, and in those instances, it is often desirable to place additional perforations into the suspected new payzone without unduly disturbing the old perforations.

The above proposed new perforations often must be formed into a highly unconsolidated formation. Accordingly, care must be taken during reentry and reperforation not to unduly distrub the old formation, or otherwise it is possible to injure the production area of the borehole to the extent that costly equipment must be brought onto location in order to repair the damage. It may be desirable that the new perforations be made in such a manner that the unconsolidated zone is not produced along with the production fluid from the old payzone.

At other times, it may be suspicioned that the prior perforations insufficiently communicated the payzone with the lower annular end of the borehole, and that employment of modern techniques might improve the production of the wellbore.

Sometimes, deposits have formed in the old perforations whereby the perforations become partially plugged. One objective might be to resurge the old perforations, without reperforating, in an attempt to increase production.

In some instances, it is desirable to have an overbalance on the producing formation, i.e. the hydrostatic head inside the tubing string is greater than the formation pressure. In that case, pressure is effected into the producing formation momentarily, thereby preventing damage to the producing payzone. Otherwise, the unconsolidated material from the payzone could flow into the cased borehole, into the tubing string, and uphole towards the surface which is undesirable in this instance.

It may also be desirable to have an overbalance such that upon perforating, hot acid in the bottom of the tubing string is forced into the formation.

In completing a new well where the payzone is a highly unconsolidated sand formation, it is sometimes desirable to have only a small pressure differential toward the tubing string. Thus, it is desirable to reduce the pressure differential to a predetermined low value to control the backsurge on the new payzone.

To achieve the desired underbalance or overbalance, various types of vent assemblies are employed to open and close the interior of the tubing string to fluid flow. One such vent assembly is shown in U.S. Pat. No. 4,299,287.

In controlling the differential pressure, it is necessary to establish a hydrostatic head in the tubing string whereby the tubing string is filled with fluid to a predetermined level. Normally, the tubing string would be filled with kerosene, diesel, nitrogen or water. The perforating gun is generally detonated by a bar and the fluids in the tubing string slow the descent of the bar as it drops through the tubing string to detonate the perforating gun. To open a bar actuated vent assembly, there must not only be sufficient impact on the vent assembly to move it into the open position, but there must be approximately 22 ft-lbs of impact for the bar to actuate the firing head. If the bar does not open the vent assembly and detonate the gun, it becomes necessary to fish the bar out of the well. Further, it is possible that the bar might get hung up on the vent assembly. If well fluids are used in the tubing string, mud and other materials may settle to the bottom so as to not only slow the descent of the bar but possibly stop the descent altogether if the debris becomes compacted.

Apparatus and method for overcoming the above-identified completion problems are the subject of this invention.

SUMMARY OF THE INVENTION

This invention comprehends both method and apparatus by which a payzone located downhole in a borehole can be recompleted. More specifically, the apparatus of the present invention enables a method to be carried out whereby reentry into a borehole and reperforation of a highly unconsolidated formation can be achieved. The method of the present invention is carried out by the provision of a tool string comprising a production tubing which extends downhole from a wellhead into a cased borehole, with there being a packer which isolates the lower annular area from the upper annular area, and a differential pressure actuated vent assembly, made in accordance with the present invention, included below the packer and above a large casing type perforating gun.

The tool string with packer, vent assembly, and perforating gun are lowered into the cased borehole closed, i.e. the vent assembly is in the closed position. As the tool string is lowered into the well, the tubing string is filled with a fluid to a predetermined level to create the desired hydrostatic head. Once the gun is located adjacent the formation to be reperforated, the packer is set.

In one form of the invention, a bar is dropped down through the axial passageway of the tubing string, which extends from the surface of the earth down to a gun firing head associated with the perforating gun. As the bar travels downhole, the bar breaks one or more frangible members extending into the axial passageway or flow bore. The broken frangible members open a fluid passageway between the interior of the tubing string and a chamber in the vent assembly which permits the pressure from the hydrostatic head to move the vent assembly from the closed to the opened position. The bar continues to fall downhole and subsequently impacts against the gun firing head, thereby detonating the shaped charges of the perforating gun. The gun firing head and the vent assembly are placed sufficiently close together so that the sequential action of opening the vent assembly and detonating the shaped charges occurs within a satisfactory time frame to prevent any loss of the controlled pressure differential.

The pressure actuated vent assembly of the present invention comprises a main body having an axial passageway formed therethrough, and an inner cylindrical sleeve which is spaced from the inner wall surface of the main body to provide an annular area between the sleeve and the main body within which a piston is reciprocatingly received. A port is formed through the sleeve and the main body so that lateral flow can occur from the exterior of the tool into the axial passageway when the port is moved to the open position.

Seal means are provided by which the piston sealingly engages the main body and the sleeve so that when the piston is reciprocated into one position, flow cannot occur through the port; and, when pressure is effected across the piston by means of the frangible members, the piston is forced to move into the open position, thereby opening the port to flow.

In another embodiment for completing a new well, pressure is effected down the tubing string, such as by creating a hydrostatic head, to communicate the fluid pressure through open ports in the vent assembly and act on the piston. The piston is thereby moved to cause the vent assembly to open.

Accordingly, a primary object of the present invention is the provision of both method and apparatus for completing a formation located downhole in a borehole.

Another object of the invention is to provide both method and apparatus by which a highly unconsolidated formation located downhole in a wellbore can be completed without damage thereto.

A further object of this invention is to disclose and provide both method and apparatus by which damaging outward flow from the payzone of a borehole does not immediately occur when the gun is initially detonated.

A still further object of this invention is to provide both method and apparatus by which a vent assembly is moved to the open position and thereafter a perforating gun is discharged.

One objective of the present invention is the use of tool string pressure for the actuation of the vent assembly where no pressure actuation from the surface is required.

Another objective of the present invention is the elimination of the necessity to further pressure up the tubing string or to take pressure off of the tubing string to actuate the vent assembly.

Another object of the present invention is to open the vent assembly without requiring any amount of energy from the bar falling through the tubing string for the detonation of the perforating gun.

A further object of the present invention is the provision of a differential pressure acuated vent assembly which is actuated solely by the pressure effected within the interior of the tool string.

A still further object of the present invention is the provision for the controlled pressure differential in front of the hydrocarbon formation for the reperforation of a producing well.

Another object of the present invention is the provision of a pressure actuated vent assembly where a bar drops through the tubing string to open a passageway which causes the vent assembly to move to the open position.

Another and still further object of the present invention is the provision of a differential pressure actuated vent assembly for connection into an oil well tool string which includes a lateral flow port closed by a valve assembly associated therewith which is moved to the open position in response to pressure effected within the interior of the tool string.

These and various other objects and advantages of the present invention will become readily apparent to those skilled in the art upon reading the following detailed description and claims and by referring to the accompanying drawings.

The above objects are attained in accordance with the present invention by the provision of a method of completing highly unconsolidated formations for use with apparatus fabricated in a manner substantially as described in the above abstract and summary.

DETAILED DESCRIPTION OF THE PREFERRED EMBODIMENT

Figure 1:
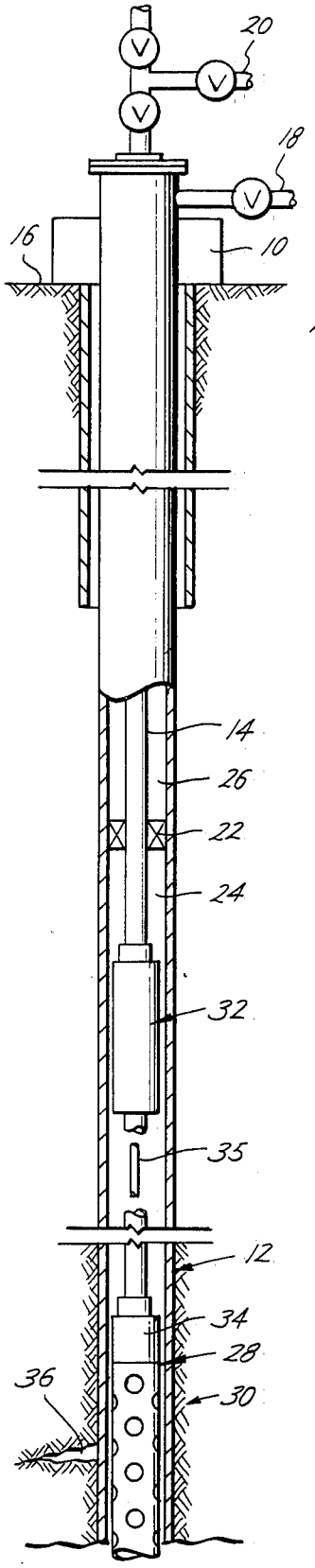
FIG. 1 is a part schematical, part diagrammatical, longitudinal, part cross-sectional view of a borehole having a vent assembly associated therewith made in accordance with this invention.

FIG. 1 of the drawings discloses a wellhead 10 which forms the upper end of a cased borehole 12. The borehole includes a tubing string 14 which extends downhole from the wellhead 10. The surface of the ground is indicated by numeral 16. Outflow pipes 18 and 20 are connected to and form part of the wellhead, in the usual manner.

A packer device 22, for example, a Baker lok-set retrievable casing packer, divides the borehole annulus into a lower annulus 24 and an upper annulus 26. A large casing type jet perforating gun 28 is positioned adjacent to a payzone 30 which is to be produced by the wellbore.

A pressure actuated vent assembly 32, made in accordance with the present invention, is connected within the tubing string and is interposed between the packer 22 and a gun firing head 34. A traveling bar 35 can be released at the wellhead 10, whereupon the bar 35 will travel down the interior of the illustrated tool string, so that the bar sequentially opens the vent assembly 32 and immediately thereafter actuates the gun firing head 34 which in turn detonates the shaped charges of the perforating gun and forms a plurality of tunnels 36 back into the payzone 30.

The gun firing head 34 can take on a number of different forms, but preferably is made in accordance with Roy R. Vann's U.S. Pat. No. 3,706,344.

The casing gun 28 can take on a number of different forms but preferably is made in accordance with Roy R. Vann's U.S. Pat. No. 4,140,188.

FIGS. 2–5 illustrate the details of the pressure actuated vent assembly 32 of this invention. As seen in FIGS. 2A and 2B, the vent assembly 32 includes a main longitudinally- extending body 38 which has a threaded connection at the upper end 40 thereof by which the main body can be connected into the tool string of FIG. 1, for example. A plurality of radial ports 42 is formed through the main body intermediate the upper end and the opposed lower end 44 thereof. The lower marginal end of the main body 38 is threadedly attached to a sub 46 so that the vent assembly can be conveniently connected into the string of tubing 14, or directly connected to the gun firing head 34, as may be desired.

Numeral 50 indicates a longitudinal axial passageway formed through the main body 38 and through an inner cylindrical sleeve 52. The sleeve 52 includes a plurality of ports 54 which is indexed in aligned relationship with respect to the before-mentioned ports 42. The sleeve 52 extends from an upper marginal end 55 downhole to a lower marginal end 41 having an annular shoulder 56 which sealingly engages, by means of O-ring 57, the inside peripheral wall surface 48 of the main body 38. A medial portion of the sleeve 52 is spaced from the inner wall surface 53 of the main body 38 to form an annular working chamber 58 therebetween, within which there is reciprocatingly received in sealed relationship a piston 60.

O-rings 63 and 64 seal the uphole marginal end of the piston 60 above ports 42, 54 in a slidable manner to the confronting walls of the annular chamber 58. Seals 68 and 70 are spaced from seals 63 and 64 below ports 42, 54 so that ports 42 and 54 are located therebetween. Ports 62 in piston 60 is formed between seals 72 and 74 and the seals 68 and 70, and is indexed with respect to ports 42 and 54 in a manner which always aligns the three sets of ports 42, 54, and 62 when the piston 60 is shifted into the open position. This will be more fully appreciated later on as the remainder of this disclosure is more fully digested.

The lower end portion 76 of the piston 60 is provided with a boss 77 which is in the form of an enlarged annular member made integrally with respect to the remainder of the piston 60. The outer surface of the boss 77 includes a seal 78 thereon in the form of an O-ring received within the illustrated circumferentially extending groove. Numeral 80 illustrates the high-pressure side of the working chamber 58, and it may be observed that piston 60 divides the working chamber into a low-pressure chamber 59 substantially at atmospheric pressure and a higher-pressure chamber 80, which is connectable to the axial passageway 50 as will be more fully described later on in this disclosure.

Variable chamber 82 in working chamber 58 is formed between shoulder 84 of the main body 38 and shoulder 88 of the boss 77 of piston 60. The variable chamber 82 and low-pressure chamber 59 are at atmospheric pressure when the vent assembly 32 is in the standby or closed configuration. Thus, any pressure in high-pressure chamber 80 above atmospheric pressure will tend to force piston 60 upwardly. A pressure differential of several hundred psi is generally required to overcome the friction in the system and open the vent assembly.

A slot 90 of limited length is jointly formed within the inner marginal surface area of the lower marginal end of the piston 60 and the outer marginal surface area of the lower marginal end of the sleeve 52. A key 92 is received within the slot 90 in fixed relationship respective to the sleeve 52 and main body 38 by means of pins 94 which anchor the lower end 96 of the key respective to a pair of spaced lugs 98. Numeral 99, shown in FIG. 3, indicates the slot which is formed between the two lugs.

Figure 5:
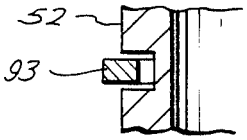
FIG. 5 is an isolated, enlarged, fragmentary view of part of the apparatus disclosed in FIG. 2.
Figure 2A:
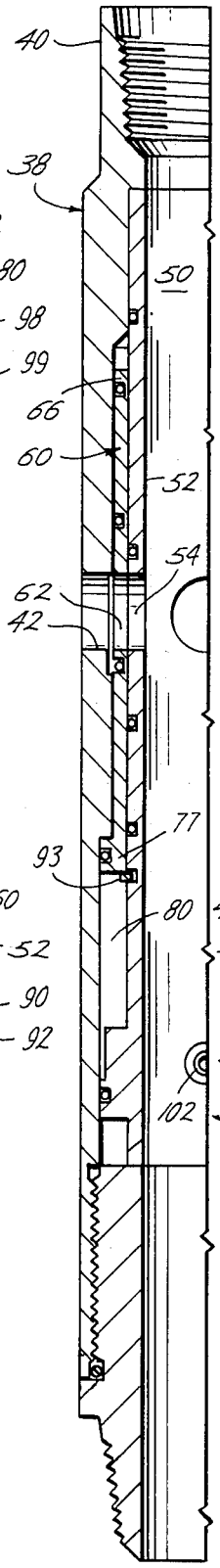
FIG. 2A is an enlarged, detailed, longitudinal, cross-sectional view of part of the vent assembly disclosed in FIG. 1 showing the vent assembly in the open position
Figure 2B:
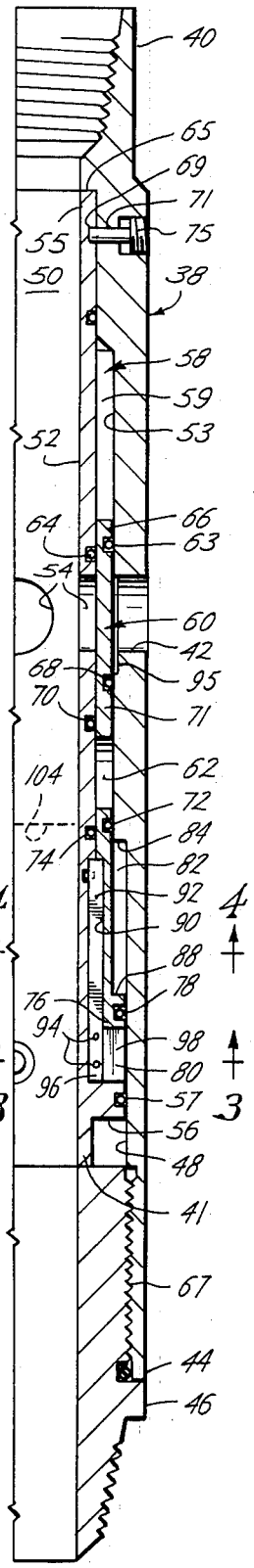
FIG. 2B is another view as in FIG. 2A with the vent assembly in the closed position.

The key 92 is placed in the slot 90 jointly formed in the sleeve 52 and piston 60. After key 92 is secured by pins 94, the snap ring 93 shown in FIG. 5 is seated over the reduced diameter end of the sleeve 52 and placed in the groove formed around the key 92 and sleeve 52. Snap ring 93 is a split ring having a space between its ends sufficient for key 92 to pass therebetween as shown in FIG. 2B. The snap ring 93 keeps the piston 60 open as shown in FIG. 2A. Once the vent assembly opens, snap ring 93 snaps out and locks the piston 60 in the open position. If all pressures were to become equalized by one of the O-rings leaking, piston 60 could fall back shut were it not for snap ring 93.

The various O-rings are properly positioned, and piston 60 and sleeve 52 are assembled within body 38. Sleeve 52 is captured and secured between downwardly facing shoulder 65 of main body 38 and the upwardly facing end of sub 46 as sub 46 is threadingly engaged to body 38 at 67. Sleeve 52 includes a blind bore 69 in its upper end for alignment with aperture 71 through body 38. A threaded alignment pin 75 is threadedly passed through aperture 71 and into bore 69 to align sleeve 52 with body 38 in order to assure that all the parts are properly oriented to axially align the three sets of ports 42, 54, and 62. Key 92 is reciprocatingly received within slot 90 and thereby insures the alignment of the three sets of ports 42, 54 and 62 upon piston 60 moving to the open position, seen illustrated in FIG. 2A. The three sets of ports 42, 54 and 62 must be aligned to permit sufficient opening for adequate flow of production fluids after perforating. The blanked portions between ports 62 in piston 60 are used for supporting the terminal ends of piston 60. It might be possible to reduce the size of the blanked areas between ports 62 so as to reduce the alignment requirement of piston 60 or possibly eliminate it altogether.

Means are provided for bleeding fluid pressure across piston 60 from lower annulus 24 to axial passageway 50 upon initial or limited upward movement of piston 60 in chamber 58. O-ring seals 68 and 70 seal piston 60 with the interior of main body 38 and the exterior of cylindrical sleeve 52. A counterbore or enlarged diameter portion 95 is disposed below ports 42 in body 38. In the closed position, O-ring 68 sealingly engages the interior of main body 38 just below enlarged diameter portion 95 such that upon the initial or a limited upward movement of piston 60 within chamber 58, O-ring 68 becomes disposed opposite enlarged diameter portion 95 so as to become sealingly disengaged from the interior of main body 38 whereby fluid pressure from lower annulus 24 may pass through ports 42, between piston 60 and main body 38, and into ports 62 in piston 60. Further, O-ring 70 disposed in sleeve 52; sealingly engages the interior of piston 60 just above ports 62. Thus, as piston 60 moves upwardly a limited extent, O-ring 70 becomes sealingly disengaged with piston 60 thereby permitting the fluid pressure, now flowing through port 62 due to the sealing disengagement of O-ring 68, to flow through ports 54 and into axial passageway 50. Thus, as piston 60 moves upwardly a limited extent, O-rings 68 and 70 sealingly disengage from body 38 and sleeve 52, respectively, to permit fluid pressure to bleed from lower annulus 24 into axial passageway 50. This bleeding of fluid pressure permits the gradual pressure release of any pressure differential between lower annulus 24 and axial passageway 50.

Figure 3:
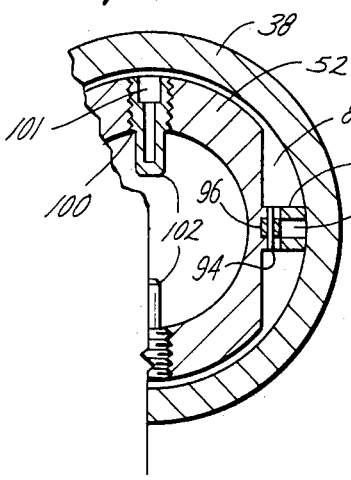
FIGS. 3 and 4, respectively, are cross-sectional views taken along lines 3—3 and 4—4, respectively, of FIG. 2.
Figure 4:
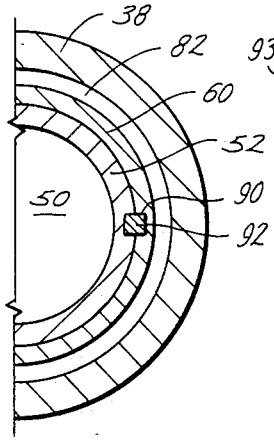

Referring now to FIGS. 2A, 2B, and 3, an isolated pilot passageway commences at 100 and provides flow into the high-pressure chamber 80. A frangible member 102 is connected to close the passageway at 100. The member 102 extends inwardly into the longitudinal axial passageway 50 formed through the main body 38 of the vent assembly 32, with there being the illustrated closed blind passageway 101 formed from the interior of the frangible member into the high-pressure chamber 80. The frangible members 102 preferably are "Kobes," which are known to those skilled in the art of downhole tools, and which are commercially available. The vent assembly apparatus 32, when incorporated within a tool string, such as disclosed in FIG. 1, for example, enables the tubing 14 to be run closed into the borehole 12 with a predetermined level of fluid such as kerosene, diesel, nitrogen or water. Such fluid creates a hydrostatic head in the tool string of at least 500 psi and preferably 1000 psi or more. When it is desired to actuate the vent assembly 32 from the closed to the opened position, the frangible members 102 are broken by utilizing the weight 35 which is dropped downhole with sufficient velocity to impact and break the outer free-end portion of the frangible members 102. This action permits the hydrostatic head in the tool string to pass into the passageway 100, into the high-pressure chamber 80, thereby forcing piston 60 uphole in chamber 58 until ports 62 become axially aligned between ports 42 and 54. The key 92 riding in slot 90 insures such alignment. In this position, the snap ring 93 latches the piston 60 into the open position.

The novel vent assembly 32 is assembled into the illustrated tool string of FIG. 1 with variable chamber 82 and low-pressure chamber 59 substantially at atmospheric pressure. Isolated pilot passageways 100 are closed by frangible members 102 whereby the interior pressure in axial passageway 50 through assembly 32 is not effected into high-pressure chamber 80 below piston 60. Piston 60 is designed to snap upwardly into the open position upon the differential pressure being placed across piston 60 by the relatively low-pressure chambers 82 and 59 at atmospheric pressure, and the relatively high-pressure chamber 80 at the tool string pressure of approximately 1000 psi. Although vent assembly 32 may be designed to open with a few hundred psi pressure differential, a pressure differential of 1,000 psi is preferred.

In utilizing the vent assembly 32 in a producing well, the producing well is killed by filling the cased borehole 12 with well fluids so as to create a hydrostatic head which is greater than the formation pressure. The formation pressure is known since the shut-in pressure of the well may be measured. Thus, where reentry and reperforation of a sensitive unconsolidated payzone 30 is being accomplished, the lower annulus 24 is pressurized by the hydrostatic head in the tool string to a value substantially greater than the pressure of the formation so as to kill the well.

The tool string with vent assembly 32 is then lowered downhole into the borehole 12. The tubing string 14 is filled with a known fluid such as water, diesel, nitrogen, or possibly even air. If air or nitrogen are used, there would be a small hydrostatic head of liquid above the firing head to cushion the fall of the weight 35 prior to detonating the perforating gun 28. Since it is the hydrostatic head within tubing string 14 which acts within high-pressure chamber 80 to actuate piston 60, it is necessary that tubing string 14 either have a hydrostatic head of fluid, or alternatively the head can be achieved by the pressurization of a compressible fluid such as air to create the necessary pressure in high-pressure chamber 80 for moving piston 60 to the open position. The relatively high pressure contained within tubing string 14 causes piston 60 to shift upwardly against the relatively low pressure contained within chambers 59 and 82, which are substantially at atmospheric pressure. As indicated earlier, it is preferred that the fluid pressure in tubing string 14 be approximately 1000 psi or more. However, the invention will operate at lower pressures. The difference between the annulus pressure in lower annulus 24 and the tubing pressure within tubing string 14 has no effect on the operation of vent assembly 32. The objective is to have a predetermined and controlled differential across the tubing string 14 and it makes no difference, as far as vent assembly 32 is concerned, whether the well is underbalanced, balanced, or overbalanced since the invention is still operable under any of these conditions.

After perforating gun 28 has been lowered to a position adjacent payzone 30, packer 22 is set to isolate lower annulus 24 from upper annulus 26. Once the packer is set, the pressure beneath packer 22 will reach equilibrium and seek its own level with respect to the formation pressure since fluid will be permitted to pass through the old perforations between cased borehole 12 and payzone 30. The producing well is still killed since tubing string 14 is closed and packer 22 has isolated the lower annulus 24.

Since the formation pressure is known because it can be measured, the necessary hydrostatic head within tubing string 14 may be predetermined so as to effect a predetermined pressure differential between the tubing and the formation. For example, if the formation pressure is 2,000 psi, the lower annulus pressure in annulus 24 will become 2,000 psi after the setting of packer 22. If tubing string 14 is lowered into the well with a 1,500 psi hydrostatic head, there will be a 500 psi pressure differential or underbalance across tubing string 14. Thus, upon the opening of vent assembly 32 and the detonation of perforating gun 28, there will be a 500 psi underbalance toward tubing string 14 which will backsurge both the old perforations and the new perforations created by perforating gun 28.

Continuing with the sequence of operation, weighted bar 35 is next dropped downhole. As bar 35 passes through central passageway 50 of the closed vent assembly 32, frangible members 102 are broken, thereby enabling fluid pressure from the hydrostatic head in tubing string 14 to flow through pilot passageways 100 and into high-pressure chamber 80. Thus, a pressure differential is created across piston 60 to shift piston 60 upwardly and latch it in the open position by means of snap ring 93. Bar 35 does not engage vent assembly 32. Shortly thereafter, and before the predetermined differential between lower annulus 24 and the interior of tubing string 14 can equalize, the traveling bar 35 strikes gun firing head 34, thereby detonating the shaped charges thereof and forming new perforations 36 into payzone 30.

At this time, the pressure in axial passageway 50 may have an underbalance, as for example 500 psi, to effect a predetermined and limited backsurge of both old and new perforations.

The fluid in the tubing string slows the bar to such an extent that it is desirable to use very little of the energy of the descent of the bar to open the vent assembly. In the present invention, it is only necessary that the bar clip the end off of the frangible members to bleed pressure into the high-pressure chamber 80 beneath piston 60 by virtue of the hydrostatic head inside the tubing string 14 to open the vent assembly. Thus, very little work or energy is required from the descent of the bar to open the vent assembly. However, a considerable amount of the energy from decellerating the bar is used to detonate the perforating gun. An insignificant amount of energy is required for the bar to merely break the frangible members, which opens passageways to the chamber beneath piston 60, so that the piston 60 will snap into the open position.

The relative volume between lower annulus 24 and the interior of the tool string 14, the area of ports 42, and the value of the hydrostatic head within the tool string 14 and within the lower annulus 24 enables the gun 28 to be located below the vent assembly 32 a distance which assures the desired pressure differential at the moment perforation of the casing is accomplished. Generally the vent assembly 32 is positioned approximately 30 feet above the gun firing head 34 so that immediately after the piston 60 commences to be shifted into the open position, the payzone 30 is perforated at 36.

It is generally undesirable to permit a substantial period of time to elapse between the opening of vent assembly 32 and the detonation of perforating gun 28. During a long time interval, the pressure differential between lower annulus 24 and the interior of tubing string 14 will tend to equalize, thereby causing the loss of the desirable pressure differential. In some cases, however, one may wish to permit the equalization of pressure and this may occur by permitting such a substantial time interval. In such a case, one might arrange the bar to break frangible members 102 to open the vent assembly 32, and then let bar 35 fall for several seconds before it impacts against the firing head to detonate perforating gun 28.

The present invention is generally used in completed wells where it is desirable to simultaneously backsurge old perforations toward the cased borehole with a controlled low differential pressure; and, at the same time, shoot new perforations into the well with the same differential pressure. In operation, the tubing string is opened by the falling bar and the cased borehole is thereafter perforated at a very close time interval so that the backsurge is approximately the same for both the old and new perforations.

In certain instances, however, where new perforations are to be effected adjacent old perforations in an old formation, the new perforations will have a substantially higher pressure than the depleted old perforations. In that case, it may be desirable to have an effective hydrostatic head which exceeds the shut-in pressure, that is, an overbalance created outward towards the formation. In such instances, the flow of production fluids first occurs back into the producing formation, and immediately thereafter, the differential pressure or overbalance decays so that pressure equilibrium is reached between the interior of the tubing string 14 and the lower borehold annulus 24. As the pressure differential between the pay zone 30 and the tubing string 14 reverses, flow will commence to occur uphole, with the final pressure differential therebetween being cautiously attained, thereby only disturbing the unconsolidated zone a minimum amount.

The present invention may also be used in the completion of a new well. In such a situation, the environment is much as shown in FIG. 1 except that cased borehole 12 will not yet have any perforations 36. In a new well it is generally desirable to have an underbalance, i.e. the interior tubing pressure is less than the formation pressure. In using this method of the present invention, the tool string as shown in FIG. 1 is run into the well with the interior of the tubing string 14 being substantially dry. Further frangible members 102 are eliminated from vent assembly 32 whereby the interior tubing pressure communicates with pressure chamber 80 through passageways 100 and on piston 60. However, since the interior tubing pressure and the pressure within low-pressure chamber 59 are substantially at atmospheric, no pressure differential exists across piston 60 to cause it to move into the open position. Shear pins may be used to insure that piston 60 does not open until a predetermined pressure differential exists.

Once the perforating gun is properly positioned, packer 22 is set and tubing string 14 is filled with a light fluid to a predetermined level. This fluid determines the desired underbalance and also creates a hydrostatic head at pressure chamber 80. This hydrostatic head causes a hydrostatic pressure on piston 60 which will cause piston 60 to move upwardly against the lower atmospheric pressure in low-pressure chamber 59. The reciprocation of piston 60 opens vent assembly 32 releasing any trapped pressure below packer 22 and permitting packer 22 to be tested. Thereafter, bar 35 may be dropped to detonate perforating gun 28.

Although the present invention has been described in the environment of a producing well, the invention can be used in a new well where a low-pressure underbalance or an overbalance is required. Further, the present invention may be used without reperforating the well where the well is shut in to build pressure and then the vent assembly is opened to back-surge the old perforations. Also, the present invention may be particularly useful in deviated boreholes where mechanically operated vent assemblies relying upon the effect of gravity may not be used.

I claim:

1. A method of backsurging a well comprising the steps of:

(1) lowering a tubing string series connected with a vent assembly and a perforating gun into a well;

(2) filling the tubing string with a fluid to a predetermined level as the tubing string is lowered into the well thereby creating a hydrostatic head within the tubing string, the hydrostatic head being lower than an anticipated pressure in a portion of the well to be backsurged;

(3) passing fluid pressure from the hydrostatic head through a passageway in the vent assembly;

(4) applying the fluid pressure through the passageway onto a piston reciprocably mounted in the vent assembly;

(5) moving the piston from a closed position to an open position for opening a flow path between the interior and exterior of the tubing string; and (6) detonating the perforating gun to perforate the well.

2. The method of claim 1 and further including the steps of:

dropping a weight through the vent assembly; and impacting the weight on a firing mechanism of the perforating gun to thereby detonate the gun.

3. The method of claim 1 and including after step (5), the step of bleeding pressure through the flow path after the piston has moved only a limited distance toward the open position.

4. The method of claim 1 and including after step (2), the step of breaking a frangible member closing the passageway to permit the passage of fluid from the tubing string.

5. The method of claim 4 and including the step of dropping a weight through the tubing string to break the frangible member.

* * * * *